United States Patent [19]

Grossmann

[11] Patent Number: 5,058,876

[45] Date of Patent: Oct. 22, 1991

[54] DEVICE FOR CONTROLLING FEEDER BLOWING AIR AND FEEDER SUCTION AIR IN A SHEET FEEDER OF A PRINTING MACHINE

[75] Inventor: Dieter Grossmann, Sinsheim-Reihen, Fed. Rep. of Germany

[73] Assignee: Heidelberger Druckmaschinen AG, Heidelberg, Fed. Rep. of Germany

[21] Appl. No.: 588,563

[22] Filed: Sep. 26, 1990

[30] Foreign Application Priority Data

Sep. 26, 1989 [DE] Fed. Rep. of Germany ..... 3931995

[51] Int. Cl.[5] ..... B65H 3/14

[52] U.S. Cl. ..... 271/98; 271/106; 271/108; 271/257; 355/312; 137/625.32

[58] Field of Search ..... 271/90, 98, 105, 106, 271/108, 256, 257, 264; 355/312; 137/625.32; 101/232

[56] References Cited

U.S. PATENT DOCUMENTS

| | | | |
|---|---|---|---|
| 2,764,407 | 9/1956 | Alix | 271/108 |
| 3,134,405 | 5/1964 | White et al. | 137/625.32 |
| 3,294,396 | 12/1966 | Staines . | |
| 3,794,071 | 2/1974 | Scott | 137/625.32 X |
| 3,884,460 | 5/1975 | Jiruse | 271/108 X |
| 3,891,205 | 6/1975 | Sunahara et al. | 271/98 |
| 4,279,412 | 7/1981 | Geatz . | |
| 4,402,592 | 9/1983 | Schön et al. | 355/312 |
| 4,699,370 | 10/1987 | Hashimoto et al. | 271/98 |
| 4,886,261 | 12/1989 | Jeshke | 271/98 X |

FOREIGN PATENT DOCUMENTS

| | | |
|---|---|---|
| 378038 | 7/1923 | Fed. Rep. of Germany . |
| 1786165 | 1/1972 | Fed. Rep. of Germany . |
| 2146121 | 4/1972 | Fed. Rep. of Germany . |
| 7141987 | 5/1972 | Fed. Rep. of Germany . |
| 8437975 | 4/1989 | Fed. Rep. of Germany . |
| 199488 | 11/1938 | Switzerland . |

*Primary Examiner*—Robert P. Olszewski
*Assistant Examiner*—C. Druzbick
*Attorney, Agent, or Firm*—Herbert L. Lerner; Laurence A. Greenberg

[57] ABSTRACT

A device for controlling feeder blowing air and feeder suction air in a sheet feeder of a printing machine having a sheet delivery, including a first control unit for controlling feeder blowing air and a second control unit for controlling feeder suction air, manual operating controls located both at the sheet feeder and the sheet delivery of the printing machine for separately actuating the first and the second control units by remote control, the first and the second control units, respectively, comprising a rotary valve with a valve housinhg and a valve member turnable in the valve housing and formed with a main opening for passing main air through the housing as well as with at least one auxiliary opening for residual air.

8 Claims, 2 Drawing Sheets

DEVICE FOR CONTROLLING FEEDER BLOWING AIR AND FEEDER SUCTION AIR IN A SHEET FEEDER OF A PRINTING MACHINE

SPECIFICATION

The invention relates to a device for controlling feeder blowing air and feeder suction air in sheet feeders of printing machines, the device having at least one rotary valve formed with a valve housing and a valve member.

By turning an actuating member, the flowing air is discharged to atmosphere; on the suction side, the vacuum pump is then connected to a suction roller.

With the aid of this heretoforeknown device, the feeder suction air and the feeder blowing air can be controlled.

A disadvantage thereof, however, is that this known device cannot separately control the feeder blowing air and the feeder suction air, respectively. A further disadvantage thereof is that this conventional device does not permit remote control. Finally, this known device does not provide any means for discharging unwanted air from the feeder.

German Petty Patent 84 37 975 exhibits a pneumatic sheet-feeder control in which feeder blowing air and feeder suction air are remotely controlled by means of two separate rotary valves.

In the German petty patent, the control of the rotary valves is accomplished by an electronic sensing switch, which detects whether a sheet is present or not. Feeder blowing air and feeder suction air are connected to a blower housing, i.e. they represent a closed circuit. A disadvantage of this heretoforeknown construction is that the valves arranged in the closed circuit cannot be operated separately.

Based upon the hereinbefore outlined technical circumstances and characteristics, the object of the invention in the instant application is to provide an improved means of operation which ensures improved control of the feeding of sheets into a printing machine and which prevents an undesired feeding-in of paper sheets.

With the foregoing and other objects in view, there is provided, in accordance with the invention, a device for controlling feeder blowing air and feeder suction air in a sheet feeder of a printing machine having a sheet delivery, comprising a first control unit for controlling feeder blowing air, and a second control unit for controlling feeder suction air, manual operating controls located both at the sheet feeder and the sheet delivery of the printing machine for separately actuating the first and the second control units by remote control, the first and second control units, respectively, comprising a rotary valve with a valve housing and a valve member turnable in the valve housing and formed with a main opening for passing main air through the housing as well as with at least one auxiliary opening for residual air.

Particular advantages of the invention are that it is possible, by means of the remote control, to provide separate means of operation, both from the sheet feeder and the sheet delivery, for both feeder blowing air and feeder suction air.

The residual air regulation represents a further advantage of the invention. Additional openings in the valve members prevent the feeding of new sheets into the printing machine after the latter has been switched off and is running down. Additional paper can be saved as a result of a reduction in the production of waste during proofing, because there is then no undefined feeding-in of new sheets into the printing machine.

A further advantage is that the residual-air regulation safely prevents the feeding-in of new sheets when the printing machine is switched off and, for this reason, there is no need for a visual inspection of feeder operation. This permits the printing machine to be operated from virtually any desired location.

In accordance with another feature of the invention, the controlling device includes rolling-contact bearings via which the valve member is mounted in the valve housing. This reduces bearing friction and provides an easy-moving mode of operation.

In accordance with a further feature of the invention, the valve member and the valve housing have a high-quality surface finish, and the valve body and the valve member have a maximum air gap of 0.03 mm therebetween. The high quality of surface finish reduces the friction in the valve, and the small air gap between the adjustable parts makes the escape of air virtually impossible. The high quality of surface finish, moreover, largely rules out any risk of corrosion due to condensation in the air lines.

In accordance with an additional feature of the invention, the controlling device includes an electromagnet connected under tension with the valve member for actuating the valve member. The electromagnets used for controlling the valve members are force-lockingly, i.e. non-positively, connected under tension to the valve member which is to be operated.

In accordance with an added feature of the invention, the controlling device includes a pneumatic cylinder, the valve member being connected to the pneumatic cylinder so as to be actuated thereby. When the blowing air has been switched off, air for preloosening the pile of sheets is still supplied to the feeder through a residual-air opening and through a bypass in the housing. When the suction air is switched off, a connection to atmosphere is created via a residual air opening in the valve member. Sheets which have previously been picked up then fall from the suction heads. It is thus possible to prevent the unintended feeding-in of new sheets into the printing machine as the latter runs down.

In accordance with an additional feature of the invention, the controlling device includes a bypass opening formed in the valve housing for blowing air; the auxiliary opening for residual air, the main-air opening and the bypass opening, in a given setting of the blowing air valve member, being aligned for passing a flow of blowing air to a pile of sheets for preloosening the sheets thereof.

In accordance with again another feature of the invention, the controlling device includes an adjusting screw threadedly mounted in the valve housing for varying a flow cross section of the bypass opening and metering the flow of blowing air through the bypass opening.

In accordance with a concomitant feature of the invention, the control device includes a bore to atmosphere formed in the valve housing for suction air; the auxiliary opening for residual air, the main-air opening and the bore, in a given setting of the suction air valve member, being connected to atmosphere.

Other features which are considered as characteristic for the invention are set forth in the appended claims.

Although the invention is illustrated and described herein as embodied in a device for controlling feeder blowing air and feeder suction air in a sheet feeder of a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
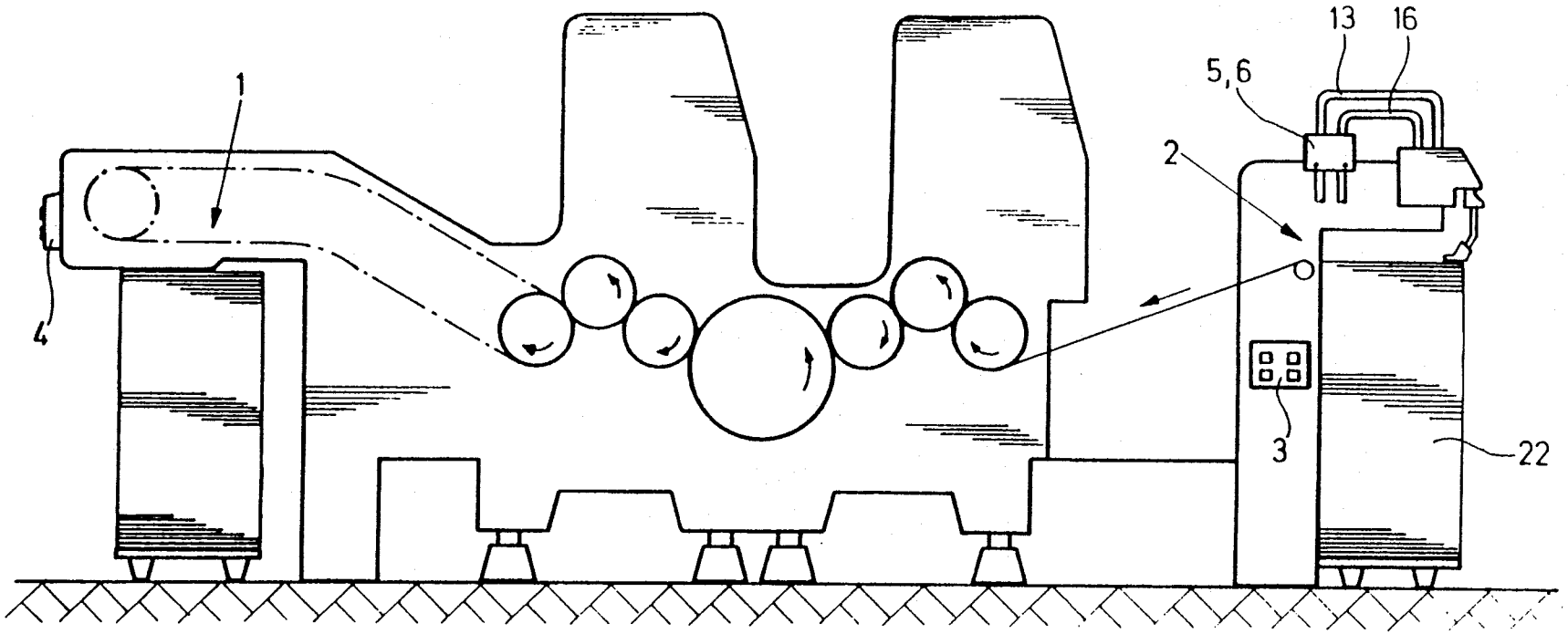
FIG. 1 is a diagrammatic side elevational view of a printing machine incorporating the device for controlling feeder blowing and suction air for the feeder thereof, in accordance with the invention.

Referring now to the drawing and, first, particularly to FIG. 1 thereof, there is shown therein a printing machine with a sheet delivery 1 and a sheet feeder 2. Besides being able to be operated via an operator console or control desk on which a number of switches are arranged and which is located at the sheet feeder 2, the printing machine may also be operated via a control desk or console 4 located at the sheet delivery 1.

Figure 2:
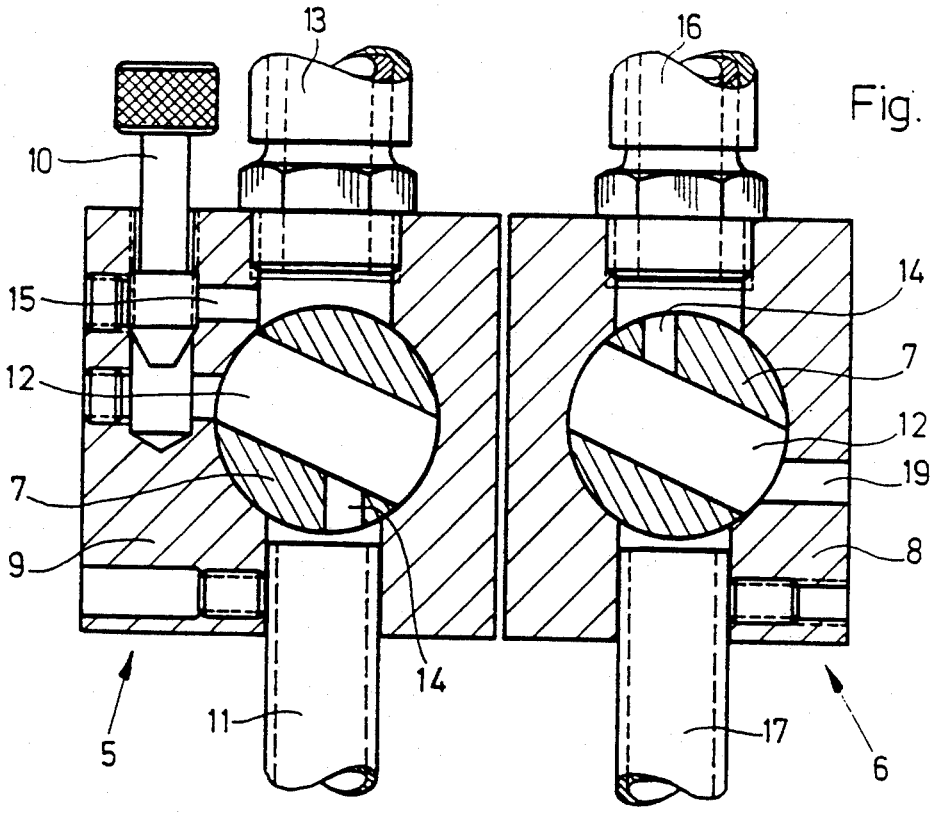
FIG. 2 is a much-enlarged fragmentary cross-sectional view of FIG. 1 showing a blowing-air/suction-air valve forming part of the controlling device.
Figure 3:
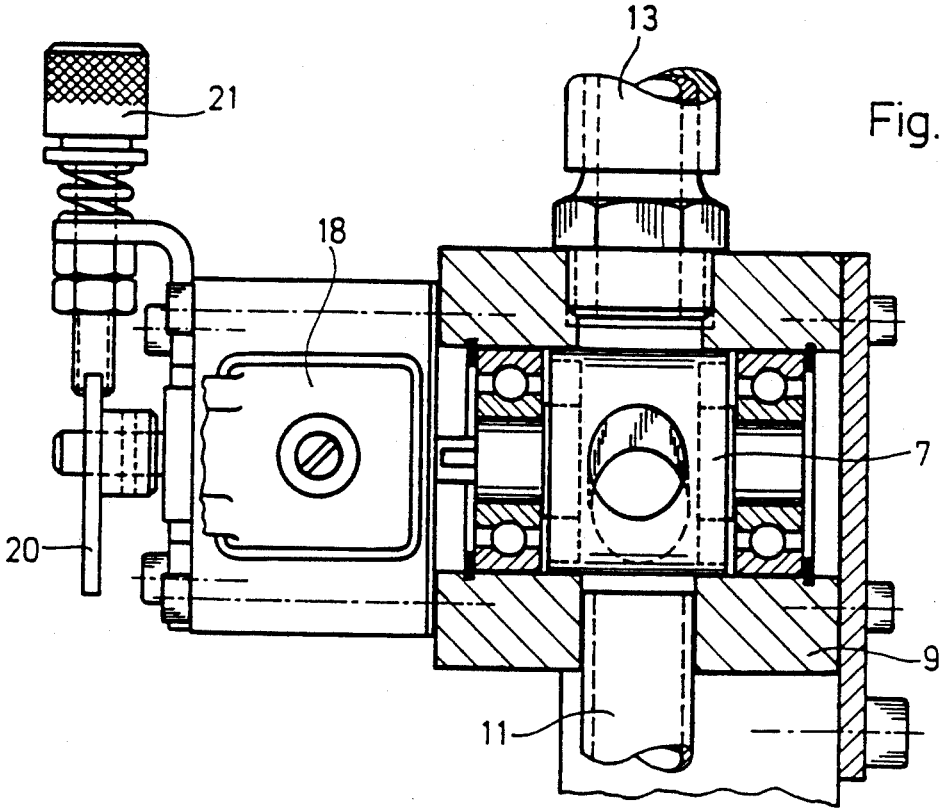
FIG. 3 is a cross-sectional view of FIG. 2 taken along the line III—III in the direction of the arrows.

FIG. 2 shows, in greater detail than in FIG. 1, the control unit 5 for feeder blowing air and the control unit 6 for feeder suction air. A valve member 7 is adjustably accommodated in a valve housing 8, 9 of the respective control units 5 and 6. The valve member 7 is formed with a main-air opening or passage 12 as well as a residual-air opening or passage 14, which is disposed at an angle to the main-air opening 12. An adjusting screw 10 is provided for regulating the blowing air for preloosening sheets in a pile of sheets 22 (FIG. 1 at the sheet feeder 2). Depending upon the adjusted position of the valve member 7, a blowing-air supply line 11 is connected to a blowing-air discharge line 13, while a suction-air supply line 16 is connected to a suction-air evacuation line 17 which, in turn, is connected to non-illustrated transport- or lift-type suckers, for example, of the printing press.

When the sheet feeder 2 is in operation, the blowing-air supply line 11 is connected, at the blowing-air side, to the blowing-air discharge line 13 via the main-air opening 12.

When the sheet feeder 2 is switched off by means of the operator console 3 at the sheet feeder 2 or by means of the control desk 4 at the sheet delivery 1, the valve body 7 is turned, so that blowing air, serving to preloosen the pile of sheets, can continue to flow to the feeder via the residual-air opening 14 and via a bypass 15 formed in the valve housing 9. The loosening air for the sheet feeder 2 is adjustably metered by means of an adjusting screw 10. A rotary-travel limiter 21 serves as a stop for a rotary cam 20, which is connected to an electromagnet 18.

With regard to the control unit 6 for feeder suction air, the suction-air supply line 16 and the suction-air evacuation line 17 are also connected to one another via the valve member 7. If the feeder suction air is switched off by means of the operator console 3 at the feeder 2 or the control desk 4 at the sheet delivery 1, the valve member 7 is adjusted by the electromagnet 18 so that the suction-air evacuation line 16, 17 is interrupted and pressure equalization with the atmosphere can take place via the openings 12, 14 and 19. The picked-up sheet then falls from the non-illustrated transport- or lift-type suckers.

The foregoing is a description corresponding in substance to German Application P 39 31 995.4, dated Sept. 26, 1989, the International priority of which is being claimed for the instant application, and which is hereby made part of this application. Any material discrepancies between the foregoing specification and the aforementioned corresponding German application are to be resolved in favor of the latter.

I claim:

1. Device for controlling feeder blowing air and feeder suction air in a sheet feeder of a printing machine having a sheet delivery, comprising a first control unit for controlling feeder blowing air, and a second control unit for controlling feeder suction air, manual operating controls located both at the sheet feeder and the sheet delivery of the printing machine for separately actuating said first and said second control units by remote control, said first and said second control units, respectively, comprising a rotary valve with a valve housing and a valve member turnable in said valve housing and formed with a main opening for passing main air through said housing as well as with at least one auxiliary opening for residual air.

2. Device according to claim 1, including rolling-contact bearings via which said valve member is mounted in said valve housing.

3. Device according to claim 1, wherein said valve member and said valve housing have a high-quality surface finish, and said valve body and said valve member have a maximum air gap of 0.03 mm therebetween.

4. Device according to claim 1, including an electromagnet connected under tension with said valve member for actuating said valve member.

5. Device according to claim 1, including a pneumatic cylinder, said valve member being connected to said pneumatic cylinder so as to be actuated thereby.

6. Device according to claim 1, including a bypass opening formed in said valve housing for blowing air; said auxiliary opening for residual air, said main-air opening and said bypass opening, in a given setting of said blowing air valve member, being aligned for passing a flow of blowing air to a pile of sheets for preloosening the sheets thereof.

7. Device according to claim 6, including an adjusting screw threadedly mounted in said valve housing for varying a flow cross section of said bypass opening and metering said flow of blowing air through said bypass opening.

8. Device according to claim 1, including a bore to atmosphere formed in said valve housing for suction air; said auxiliary opening for residual air, said main-air opening and said bore, in a given setting of said suction air valve member, being connected to atmosphere.

* * * * *